United States Patent [19]

Lawson

[11] 4,362,194

[45] Dec. 7, 1982

[54] MANUALLY MOBILE FIREWOOD LOG SPLITTER

[76] Inventor: Jack O. Lawson, R.D. #4, Ephrata, Pa. 17522

[21] Appl. No.: 229,453

[22] Filed: Jan. 29, 1981

[51] Int. Cl.[3] ..... B27L 7/00

[52] U.S. Cl. ..... 144/193 R; 144/193 C; 254/104; 173/91

[58] Field of Search ..... 173/91; 299/23; 145/2 R; 144/193 R, 193 A, 193 C, 193 D; 254/104

[56] References Cited

U.S. PATENT DOCUMENTS

| | | | |
|---|---|---|---|
| 299,086 | 5/1884 | Over . | |
| 2,475,041 | 7/1949 | Mattson . | |
| 2,629,985 | 3/1953 | McDowell . | |
| 3,050,095 | 8/1962 | Prather . | |
| 3,285,304 | 11/1966 | Fuller . | |
| 3,982,572 | 9/1976 | Kortendick . | |
| 4,102,373 | 7/1978 | Winiasz | 144/193 A |
| 4,211,264 | 7/1980 | Cross . | |
| 4,280,540 | 7/1981 | Meacham | 144/193 C |
| 4,294,298 | 10/1981 | Otte, Jr. | 144/193 C |

FOREIGN PATENT DOCUMENTS

| | | | |
|---|---|---|---|
| 1084814 | 9/1980 | Canada | 144/193 A |

*Primary Examiner*—W. D. Bray

*Attorney, Agent, or Firm*—Samuel M. Learned, Jr.

[57] ABSTRACT

The device hereof comprises a manually mobile firewood log splitter adapted in the preferred embodiment version to be operable by a single individual upon relocatable movement thereof as needed from one use location to another, which device incorporates as features thereof a wheeled positioning and aligning support frame structure to enable an accurate adjustable placement of the cutting edge of any one of various interchangeable splitting blades at a selected position upon a particular firewood log section to be split, whereupon the operating individual step-mounts a pivotally deflectable spring biased elevating step integral to the support frame structure thus causing downwardly depending leg stancions thereof to engage the ground surface under operator weight and thus frictionally immobilize movement of the log splitting device to thereby effect retention of the set positioning fix of the selected splitting blade cutting edge upon a log section end for commencement of splitting operations, being thereafter accomplished by the operating individual manually elevating an aligned slidable hammer axially along a vertically extending rod and then releasing the hammer in aligned free-fall to strike an intercommunicating splitting blade anvil and thereby effect an accurate and efficient transfer of slidable hammer impact force to the downwardly disposed splitting blade cutting edge in set retained position upon the firewood log section and thus cause a splitting thereof.

10 Claims, 18 Drawing Figures

MANUALLY MOBILE FIREWOOD LOG SPLITTER

BACKGROUND OF THE INVENTION

The instant invention relates to a manually mobile firewood log splitter wherein the structural apparatus combination thereof provides a self-contained splitting assembly mounted upon and carried by means of a wheeled support frame therefor the latter of which serves first as a transport means in accomplishing manual removal from one location to another in displacing the splitting assembly for accurately positioning the splitting blade thereof upon a firewood log section preparatory to commencement of splitting operations thereon, and second as a combined user work station and immobilized splitting assembly platform to provide both user protection features and accuracy in retention of set of splitting blade positioning during the carrying out of splitting operations.

Under the circumstances of current and ever increasing use of wood as an alternate and/or supplement fuel source to both electricity and petroleum products in providing domestic heating needs, and whereas an average size reasonably modern domestic dwelling for a family of four located in the Northeastern United States, for example, when fully heated with a wood burning stove or furnace requires an estimated six to eight cords of cut, split, and seasoned hardwood per heating season to provide reasonable heating comfort, and in view of the increasing costs for commercially available firewood, many wood burning heat users are as in bygone times now acquiring wood lots and cutting and splitting their own firewood.

Traditional among those relatively simple hand tools available for accomplishing the splitting of firewood log sections are the sledgehammer and wedge or splitting maul combined version thereof, either of which tools are fairly inexpensive and reasonably suitable, with proper eye protection, for use in meeting occasional firewood splitting needs. There are now further available for such use in the foregoing application various firewood log splitting devices which embody the employment of slidably displaceable supported splitting wedges in combination with sledgehammer impact tools, exemplary of which are those as respectively taught in U.S. Pat. No. 3,982,572 to Kortendick dated Sept. 28, 1976, and U.S. Pat. No. 4,211,264 to Cross dated July 8, 1980.

For use by commercial firewood suppliers there has been developed a whole family of trailer mounted integral engine hydraulic powered heavy duty ram splitters, exemplary of which would be that as taught by Fuller in his U.S. Pat. No. 3,285,304 dated Nov. 15, 1966.

The present invention provides a firewood log splitting device within both a cost and capacity capability for accomplishing firewood log splitting intermediate the simple hand tool implements and the powered heavy duty ram splitters, is manually mobile and self-contained with a splitting assembly in one version embodying a slidable hammer means for accomplishing splitting blade driving and in another version a manually operable hydraulically powered ram means therefor both of which versions feature the interchangeable use of different configured compound wedge blade structures.

Employment of slidable hammer means for use in driving pointed implements is well known in the arts of post, stake, and pike drivers such as respectively taught in U.S. Pat. No. 299,086 to Over dated May 20, 1884, U.S. Pat. No. 2,629,985 to McDowell dated Mar. 3, 1953, and U.S. Pat. No. 3,050,095 to Prather dated Aug. 21, 1962. Even more pertinent to the present teaching employing a slidable hammer means for accomplishing splitting blade driving is that disclosure by Mattson in U.S. Pat. No. 2,475,041 dated July 5, 1949, for a percussive type wood chisel. In the area of hydraulically driven splitting rams the teaching by Fuller cited supra is exemplary.

The employment of compound splitting blade structures to improve and enhance the firewood log section splitting device efficiency is likewise taught in the prior art, for both manual and powered splitting devices, also as respectively exemplified by the previously cited teachings of Kortendick and Fuller.

It should be understood that some of the features of the instant invention have, in some cases, structural and functional similarities to certain of those teachings separately set forth in the prior art disclosures heretofore cited and briefly discussed. However, as will hereinafter be pointed out, the instant invention is distinguishable from said earlier inventions in one or more ways in that the present invention has utility features and new and useful advantages, applications, and improvements in the art of firewood log splitters not heretofore known.

SUMMARY OF THE INVENTION

It is the principal object of the present invention to provide a manually mobile firewood log splitter having a wheeled support stand structure therefor adapted to facilitate displacement and positioning of the splitting assembly and blade thereof relative to a firewood log section to be split, and thereafter by means of the user then standing upon a pivotally operable elevating step integral thereto and causing the leg stancions thereof to engage the ground surface thereby providing both a combined user work station and an immobilized support structure for said splitting assembly after blade positioning and during the employment thereof in accomplishing firewood log section splitting operations.

It is another object of the present invention to provide a manually mobile firewood log splitter embodying a splitting assembly therefor which is totally self-contained in the respect of providing an elongated vertically upward extending blade support and slidable hammer guide shaft with a slidable hammer impact anvil fixedly interposed axially intermediate thereof to function as an impact surface for said slidable hammer in the receiving and transfer of impact force therefrom through the connecting blade support shaft to the splitting blade set upon a firewood log section in effecting the splitting thereof.

It is a further object of the present invention to provide a manually mobile firewood log splitter which enables the accurate positioning and retention thereat of the cutting edge of the splitting blade thereof upon a firewood log section to be split, and then enable with an exertion of minimum user effort the bringing to bear upon said splitting blade cutting edge the maximum application of a directed splitting force impact accurately applied thereto in effecting splitting of said firewood log section.

It is also an object of the present invention to provide an alternate version blade driving means of the manually mobile firewood log splitter incorporating in place of the slidable hammer means heretofore described the embodiment of a manually operable hydraulically powered splitting assembly.

Still another object of the present invention is to provide a manually mobile firewood log splitter, irrespective of blade driving means, adapted to enable the replacement or interchange of splitting blades in adapting the splitting blade configuration and type to the splitting characteristics of the particular firewood log section species to be processed.

It is an additional object of the present invention in both blade driving versions thereof to provide a manually mobile firewood log splitter which is safe and easy to use and is particularly well suited to meet the intermediate capacity needs of a firewood user having more than an occasional but less than a commercial requirement for split firewood, such as a homeowner employing as a primary domestic heating means a wood burning stove, furnace, or fireplace.

Details of the foregoing objects and of the invention, as well as other objects thereof, are set forth in the following specification and illustrated in the accompanying drawings comprising a part thereof.

FIGS. *7a, 7b,* and *7c* are respectively front, side, and top views of a half-flanged wedge blade structure adapted for interchangeable use with said manually mobile firewood log splitter in either the slidable hammer or hydraulically powered splitting assembly versions thereof.

FIGS. *8a, 8b,* and *8c* are respectively front, side, and top views of a compound wedge blade structure adapted for interchangeable use with said manually mobile firewood log splitter in either the slidable hammer or hydraulically powered splitting assembly versions thereof.

FIGS. *9a, 9b,* and *9c* are respectively front, side, and top views of a half-flanged compound roller wedge blade structure adapted for interchangeable use with said manually mobile firewood log splitter in either the slidable hammer or hydraulically powered splitting assembly versions thereof.

FIGS. *10a, 10b,* and *10c* are respectively front, side, and top views of a full-flanged compound roller wedge blade structure adapted for interchangeable use with said manually mobile firewood log splitter in either the slidable hammer or hydraulically powered splitting assembly versions thereof.

DETAILED DESCRIPTION OF THE INVENTION

Figure 1:
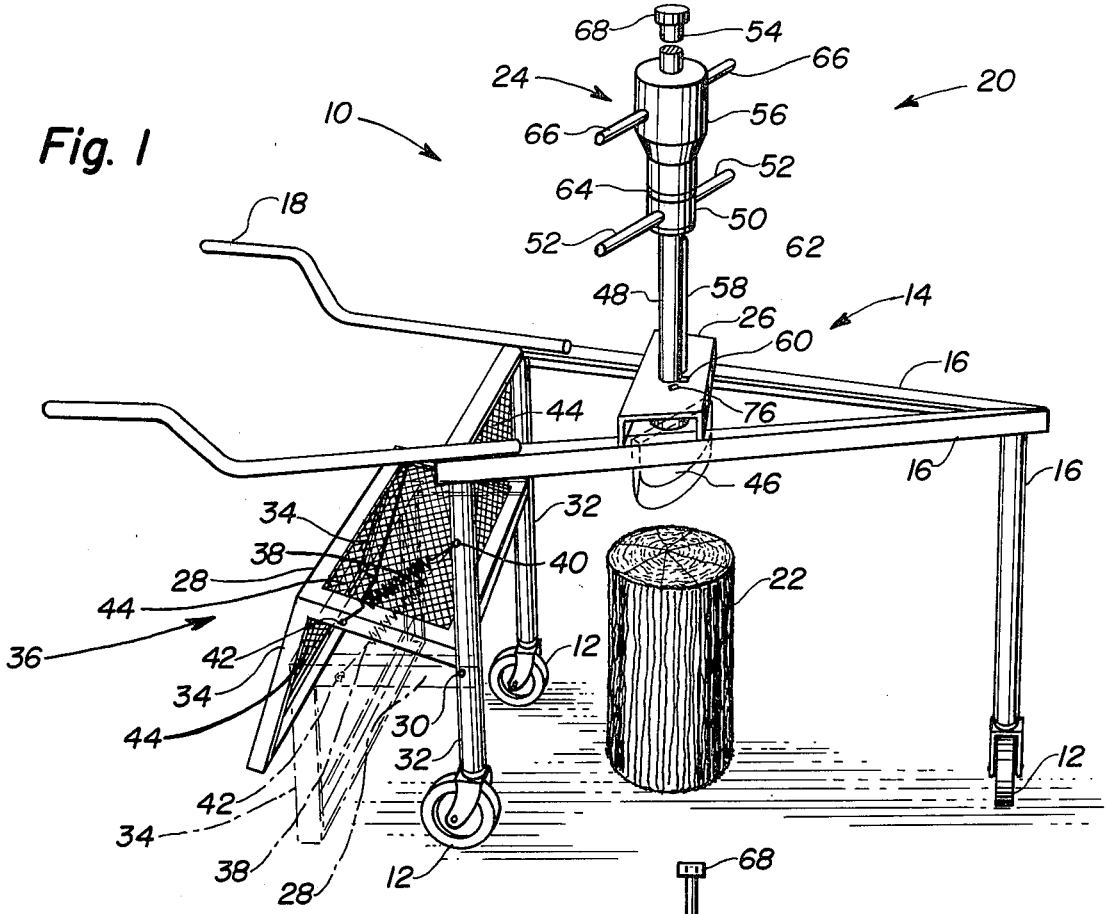
FIG. 1 is a perspective side elevation of the manually mobile firewood log splitter comprising the instant invention, shown displaced in relative operational position with respect to an exemplary firewood log section for splitting, wherein the elongated vertically extending slidable hammer guide shaft thereof, however, has been foreshortened to accommodate the view to the sheet.

Referring to FIG. 1, the present invention is shown which comprises a manually mobile firewood log splitter 10 mounted upon casters 12, said firewood log splitter having a rigid supporting frame structure 14 comprised of interconnected horizontally and vertically disposed structural support members 16, a spaced set of rearwardly projecting handles 18 to facilitate manual displacement movement thereof from one use location to another and thereupon effect accurate positioning of a splitter assembly 20 relative to an exemplary firewood log section 22 to be split, said splitting assembly 20 being secured in the instantly shown slidable hammer version 24 thereof within said rigid supporting frame structure 14 by means of insertable retention through a splitting assembly platform member 26, all of which structure is immobilized in use positioning disposition by means of a pivotally elevating step 28 adapted upon step-mounting thereof by a user to frictionally engage the ground surface and thereby fixedly establish and retain said log splitter 10 in a set position and also at the same time provide a safe work station location for a user during the employment of said manually mobile firewood log splitter 10 in accomplishing the splitting of firewood log sections.

Referring again to FIG. 1 to describe in greater detail the component parts of the slidable hammer version 24 of this invention as well as certain aspects of the operation thereof, wherein is shown in phantom also the deployment in ground surface frictional engagement said pivotally elevating step 28 which rotates about connecting rod 30 insertably communicating between and through the rear caster support legs 32 of said rigid supporting frame structure 14 such that the stancions 34 of said step 28 engage the ground surface when user step-mounted, which step 28 and stancions 34 thereof are otherwise retained in a normally pivotally upward disposition position 36 by tension spring 38 connectably inter-communicating from the rear caster support leg pin 40 to the step pin 42. It will also be noted that the step 28 as well as the dependent leg stancion panel thereof and the upwardly disposed facing frame section panel are all provided with a structural support and safety screen 44.

Figure 2:
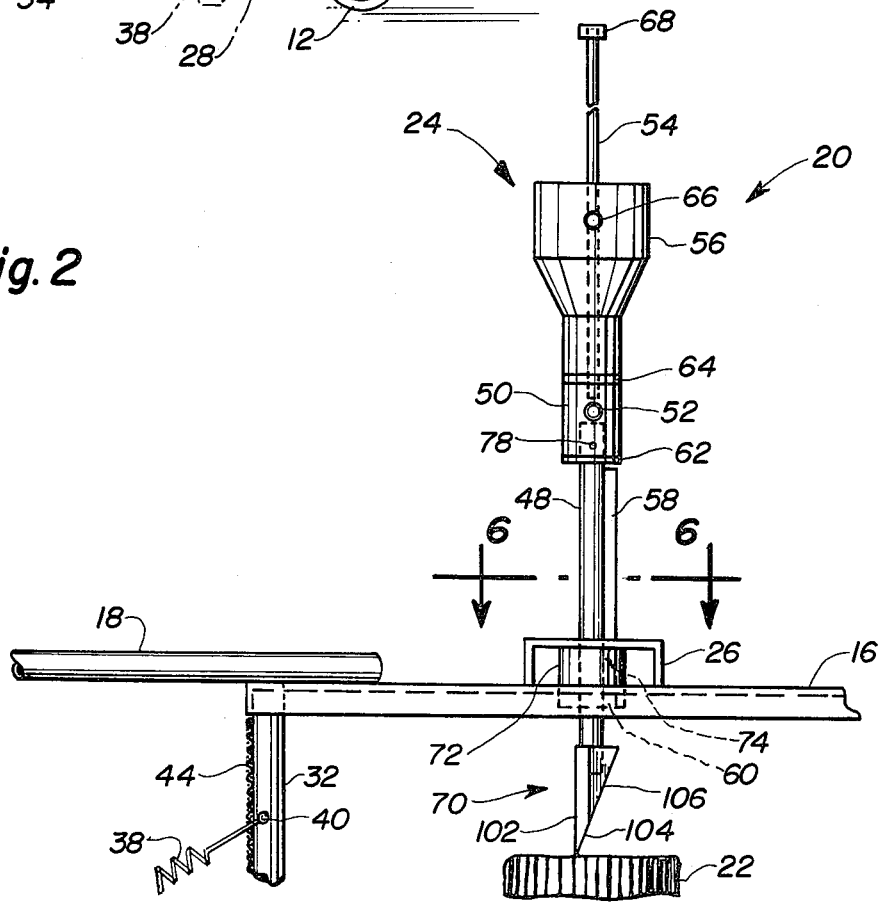
FIG. 2 is an enlarged side elevation of the splitting assembly section of said manually mobile firewood log splitter showing a positioning of the cutting edge of the splitting blade thereof upon an exemplary firewood log section to be split, wherein the elongated vertically extending slidable hammer guide shaft of said splitting assembly and said exemplary firewood log section have both been foreshortened to accommodate the view to the sheet.
Figure 3:
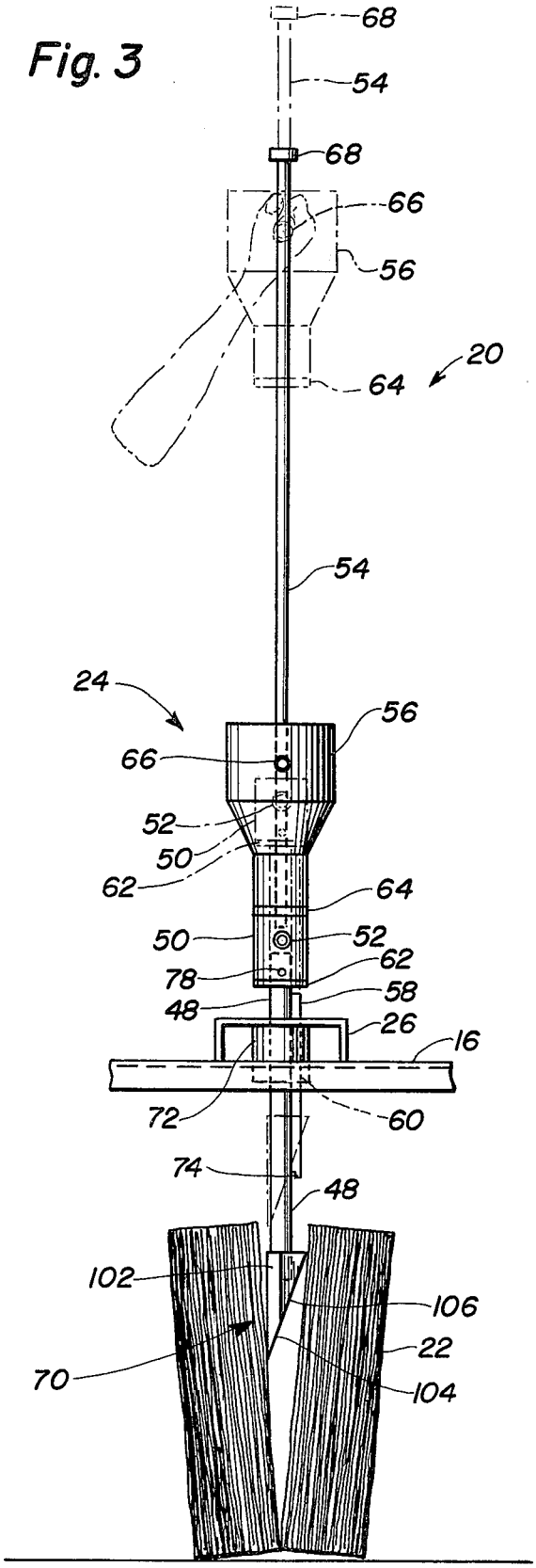
FIG. 3 is an enlarged side elevation of the splitting assembly of said manually mobile firewood log splitter therein illustrating in phantom the manual guided elevation and directed release splitting force impact operation of the slidable hammer of said splitting assembly upon the slidable hammer impact anvil in receiving and causing transfer of impact force therefrom through the connecting blade support shaft to the splitting blade in accomplishing the splitting of an exemplary firewood log section.

Other structural aspects of the present invention shown in FIG. 1 are those of the splitter assembly 20, and in particular the slidable hammer version 24 thereof which includes a splitting blade 46 detachably assembled to the splitting blade support shaft 48 at the lower end thereof and at the upper end thereof threadably assembled on axial alignment into the lower end of the cylindrical shaped slidable hammer impact anvil 50 which in turn is provided with opposingly disposed perpendicularly projecting anvil handles 52 for ease of manipulation, and threadably assembled on vertically upward projecting axial alignment into the upper end of the cylindrical shaped slidable hammer impact anvil 50 is the slidable hammer guide shaft 54 by which the slidable impact hammer 56 is insertably retained and guided in upward lifting vertical displacement and downward release free-fall impact with said anvil 50 during the accomplishment of wood splitting operations as more particularly shown in FIG. 3 to be hereinafter more fully described. Other slidable hammer version splitter assembly features illustrated in FIG. 1 include the splitting blade support shaft elevating keeper lug and guide flange 58 whereby the splitting blade 46 is maintained by rotatable stop-engagement thereof with the splitter assembly platform member 26 in an elevated disposition as shown while accomplishing placement positioning of said manually mobile firewood log splitter 10 with respect to an exemplary firewood log section 22 preparatory to the commencement of splitting operations thereon, after which the splitting blade support shaft is counter-rotated from the keeper position thereof by means of anvil handles 52 to align said elevating keeper lug and guide flange 58 with the platform member release slot 60 whereupon said splitting blade is brought to bear as desired at a set location upon the firewood log section to be split as more particularly shown in FIG. 2 to be hereinafter more fully described. It will also be noted that the cylindrical shaped slidable hammer impact anvil 50 is provided about the lower peripheral surface thereof with an anvil cushion gasket 62 so as to provide a buffer in the event said anvil 50 should come into contact with the upper surface of said splitting assembly platform member 26. There is additionally provided a slidable impact hammer gasket 64 assembled to the slidable impact hammer 56 as more particularly shown in FIG. 5 to be hereinafter more fully described, which gasket 64 serves to prevent metal-to-metal impact and the otherwise consequent flying metal chip eye hazard. Further, in order to facilitate lifting and manipulation thereof, the slidable impact hammer 56 is also provided with a set of opposing perpendicularly projecting hammer handles 66, and to prevent accidental lifting of the slidable impact hammer 56 from the guide shaft 54 during elevation thereof in use application the latter is provided with a threadably detachable slidable impact hammer elevation stop 68.

Figure 4:
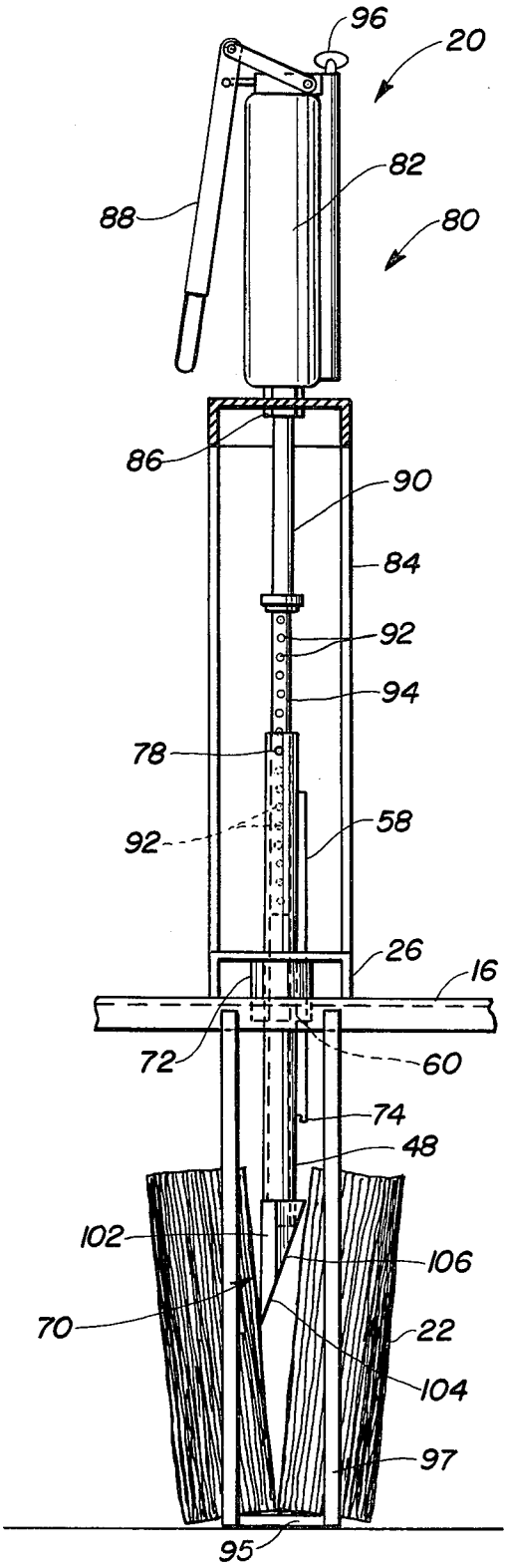
FIG. 4 is an enlarged side elevation of a manually operable hydraulically powered splitting assembly modified version of said manually mobile firewood log splitter.

The manually mobile firewood log splitter 10 as shown in FIG. 1, being the slidable hammer version thereof, as well as the hydraulically powered splitting assembly modification version thereof as illustrated in FIG. 4 to be hereinafter more fully described, are both preferably constructed of metal alloy and high-impact plastic materials, but any other suitable materials or combinations thereof may be used.

Referring now to FIG. 2, which is an enlarged side elevation of the slidable hammer splitter assembly generally as illustrated in FIG. 1, here, however, being shown provided with a half-flanged wedge blade 70 compound splitting blade and further shown with the splitting blade support shaft 48 disengaged from the previously described elevated keeper position so that said blade 70 may be accurately set by the user as desired upon a selected firewood log section 22 preparatory to commencement by the user of accomplishing splitting operations thereon. Also shown more clearly in FIG. 2 is additional structural detail of the splitting blade support shaft guide and elevation retention means, being respectively the splitting blade support shaft guide bushing 72 to provide lateral support for the entire splitter assembly 20 and the keeper lug detent extension 74 which keys into a keeper lug detent extension slot 76 provided in the splitting assembly platform member 26 not seen in FIG. 2 but clearly shown in the enlarged top sectional view of FIG. 6 as taken along the line 6—6 of FIG. 2. Again, the view shown in FIG. 2 illustrates the slidable hammer splitter assembly located and splitter blade set ready position relative to a firewood log section 22 to be processed preparatory to the accomplishment of splitting operations thereon.

In FIG. 3 is shown the preferred method of employing a located and set slidable hammer version 24 of said manually mobile firewood log splitter 10 in accomplishing firewood log section splitting operations, wherein the phantom splitting assembly view illustrates a located and splitter blade set ready positioning thereof as previously described in consideration of FIG. 2, but, however, with the slidable impact hammer 56 thereof shown user elevated along the slidable hammer guide shaft 54 upward of the slidable hammer impact anvil 50 and on guided axial alignment therewith by means of said guide shaft 54 just prior to the free-fall release of said slidable impact hammer 56. Although not shown in FIG. 3 it is to be understood that the user has as previously described step-mounted the pivotally elevating step 28, and so remains for the duration of that time now described, thus causing said step to pivotally deflect downward under said user's weight against the force of tension spring 38 and thus frictionally engage the ground surface thereby to fixedly establish and retain said log splitter 10 as well as the splitter assembly 20 and blade 70 thereof in a position as previously located and set and also at the same time provide a safe work station location for said user during the employment of said manually mobile firewood log splitter 10 in accomplishing the splitting of firewood log sections 22. Also shown in FIG. 3 is the splitting blade support shaft retaining pin 78 which communicates through aligned openings in the slidable hammer impact anvil 50 and the splitting blade support shaft 48 as shown whereby the latter is prevented from an accidental release during employment of said firewood log splitter 10 in use application.

The solid line illustration of said slidable hammer version 24 shown in FIG. 3 is of the splitter assembly configuration after user release of the slidable impact hammer 56 to cause impact contact thereof with the slidable hammer impact anvil 50 thus transmitting therethrough the impact force to the blade by means of interconnecting splitting blade support shaft 48 and in turn effecting a directed driving of the half-flanged wedge blade 70 from the set position into the firewood log section 22 thus resulting in a splitting thereof as shown.

Figure 6:
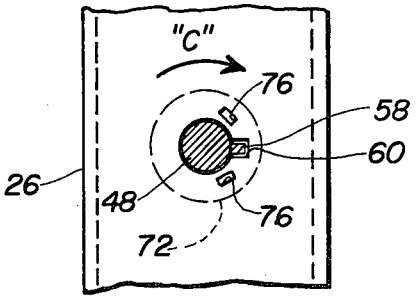
FIG. 6 is an enlarged top sectional view of the blade support shaft retraction keeper shown in FIG. 2 as seen along the line 6—6 thereof.
Figure 7A:
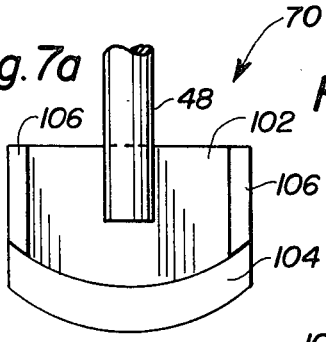
Figure 7B:
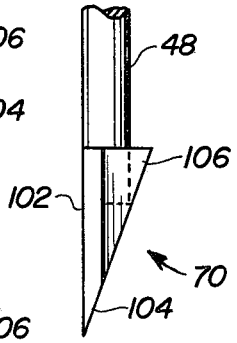
Figure 7C:
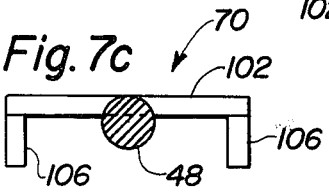
Figure 8A:
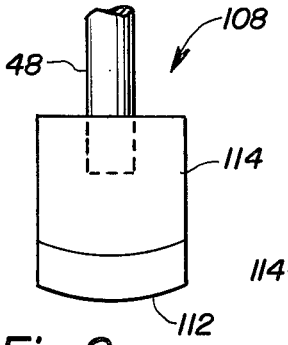
Figure 8B:
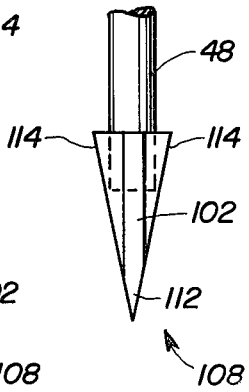
Figure 8C:
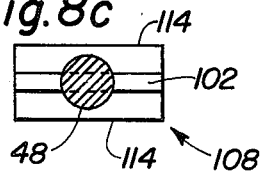

Reset of the slidable hammer version splitting assembly for continued splitting operation employment, from that position as shown in solid line illustration in FIG. 3 to the splitting assembly elevated and locked position as shown and previously discussed in consideration of FIG. 1, is accomplished by the user grasping the anvil handles 52 and thereby elevating the entire slidable hammer splitter assembly 24 to a height where the keeper lug detent extension 74 clears the top of the splitting assembly platform member 26 and said assembly 24 may be rotated such that said keeper lug detent extension 74 is aligned with and made ready to engage the keeper lug detent extension slot 76 whereupon the user releases his grasp upon said anvil handles 52 and detent extension 74 engagement with said detent extension slot 76 is made and said assembly 24 is locked in the elevated keeper position as shown in FIG. 1, and more clearly followed by reference to FIG. 6, for relocation positioning of said manually mobile firewood log splitter 10 in the accomplishment of continued splitting operations.

Referring now to FIG. 4 wherein is illustrated the manually operable hydraulically powered splitting assembly version 80 of said manually mobile firewood log splitter 10, employing in place of the slidable hammer assembly a hand operated hydraulic cylinder 82 supported in affixment to a splitting assembly platform member extension 84 by means of a cylinder attachment compression nut 86 as shown, said cylinder 82 being manually operable by means of handle 88 to be pressurized and hydraulically extend piston 90 connected to the splitting blade support shaft 48 by insertion of a splitting blade support shaft retaining pin 78 in communicable connection through one of a vertically spaced plurality of blade extension adjustment openings 92 in a piston extension 94 connected to said piston 90 whereby is made mechanical accommodation of the piston extension capability and the necessary depth of hydraulic driving of the splitting blade into a firewood log section 22, depending on the length of said log section, to effect a splitting thereof in compressive engagement between the downward moving splitting blade when forced thereby against a log section retaining plate 95 which in turn is retained in a depending fixed spaced relationship as to the respective structural support members 16 of the rigid supporting frame structure on either lateral side thereof by means of the log section retaining plate connecting and supporting bracket members 97 assembled thereto. Once log section splitting is accomplished as shown in FIG. 4 retraction of the splitting blade support shaft 48 for continued hydraulic powered splitting operations is enabled by turning the hydraulic pressure release valve 96 to release hydraulic pressure and permit an elevation of said splitting blade support shaft and a withdrawal of the splitting blade thereto assembled from the log section thus split.

Figure 5:
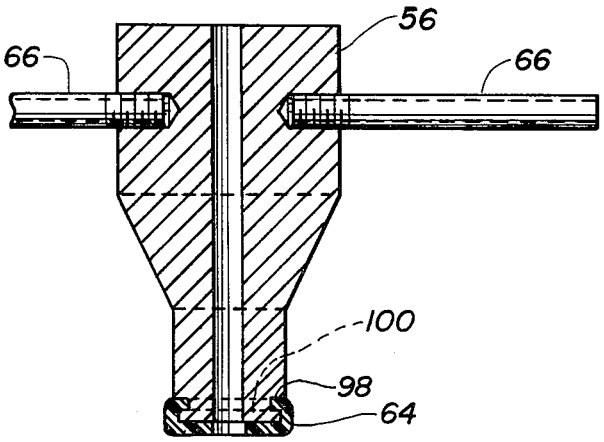
FIG. 5 is an enlarged side sectional elevation of the slidable impact hammer structural detail.

The view shown in FIG. 5 is an enlarged side sectional elevation of the slidable impact hammer 56 employed with the slidable hammer splitter assembly 24, wherein is illustrated structural detail of the slidable impact hammer gasket 64 and the method of affixment to said hammer which is by means of engaging an inwardly facing annular flange 98 thereof within a peripheral hammer recess ring 100 such that said gasket is securely retained in place upon the impact surface of said hammer to thereby serve as an impact buffer in preventing metal-to-metal contact with the impact anvil 50 and also thereby substantially eliminate flying metal fragment eye hazards during employment in splitting operations of the slidable hammer version of said firewood log splitter 10.

As previously discussed, the illustration shown in FIG. 6 is an enlarged top sectional view of the splitting blade support shaft elevation keeper assembly shown in the released blade lowered configuration wherein the splitting blade support shaft 48 has been lifted to disengage the keeper lug detent extension 74 (not shown in FIG. 6) from the keeper lug detent extension slot 76 and rotated in the direction of arrow "c" that angular displacement distance necessary such that the splitting blade support shaft elevating keeper lug and guide flange 58 is aligned with the platform member release slot 60 as shown and thereby enabled to pass therethrough so the splitting blade 46 as shown in the elevated position in FIG. 1 may be released therefrom and lowered into a selected position upon a firewood log section 22 to be split as shown in FIG. 2. It will be noted the splitting assembly platform member 26 is provided with two keeper lug detent extension slots 76 radially spaced respectively angular displacement distances both left and right of said platform member release slot 60 whereby elevated keeper engagement and release therefrom of the splitting blade support shaft 48 for either right or left handed user individuals is facilitated. Re-positioning of the splitting blade in an elevated and retained position, after accomplishment of splitting operations upon a particular firewood log section so the firewood log splitter 10 may thereupon be manually displaced for continued wood splitting processing operations at another use location, is simply accomplished by a reverse of the releasing procedure sequence above described.

Considering now the various types of splitting blades which may be interchangeably employed with either the slidable hammer version 24 or the manually operable hydraulically powered splitting assembly version 80 of said firewood log splitter 10, wherein that splitting blade illustrated in front, side, and top views as shown respectively in FIGS. *7a*, *7b*, and *7c* is a half-flanged wedge blade 70 which is also that splitting blade previously shown in FIGS. 2, 3, and 4, being a general purpose splitting blade best suited for use in processing firewood log section species of moderately tough woods with relatively straight grain such as wild cherry or red oak. It will be noted the half-flanged wedge blade 70 is characterized by having a blade body 102 ground to a single taper cutting edge 104 and provided on the blade tapered side thereof with a spaced set of flanged wedges 106 having tapered sides corresponding to and effectively extending the tapered cutting edge 104 into a splitting wedge configuration such that once a firewood log section split is initiated by the tapered cutting edge then a migration of that split start to effect separation of the log section into halves or otherwise is completed by the downward force lateral translation thereto through flanged wedges 106. It is to be noted and understood the half-flanged wedge blade 70 may be used with equal ease and facility in accomplishing firewood log section splitting operations, as respectively shown in FIG. 3 and FIG. 4 earlier herein discussed, with either the slidable hammer version 24 or manually operable hydraulically powered splitting assembly version 80 of said firewood log splitter 10.

The splitting blade illustrated respectively in FIGS. *8a*, *8b*, and *8c* is a compound wedge blade 108, and that splitting blade illustrated respectively in FIGS. *9a*, *9b*, and *9c* is a half-flanged compound roller wedge blade 110, both of which blades are particularly well suited for employment with either the slidable hammer version 24 or the manually operable hydraulically powered splitting assembly version 80 of said firewood log splitter 10 in processing firewood log section species of tough woods with knurled grains such as is frequently the case with either white oak or hickory. The compound wedge blade 108 is provided with a double tapered cutting edge 112 and further provided on either side of the blade body 102 thereof with cutting edge wedge extensions 114 corresponding and effectively extending the double tapered cutting edge 112 into both a cutting and splitting wedge configuration such that once a tough knurled grain firewood log section split is initiated by means of the double tapered cutting edge then a migration of that split start to splitting completion is provided by the wedge extensions 114 and any knurled grain obstructions to such log section splitting are cut through by said double tapered cutting edge 112.

The half-flanged compound roller wedge blade 110 embodies the basic half-flanged wedge blade structure as earlier described with reference to FIGS. series *7a*, *7b*, and *7c*, but as illustrated in FIGS. *9a*, *9b*, and *9c* further incorporates the embodiment of wedge rollers 116 which serve to reduce contact surface between the splitting blade and firewood log section being split, and thus further serve to reduce friction and enhance the ease of accomplishing the splitting of tough woods with knurled grains such as, for example, white oak or hickory.

Figure 10A:
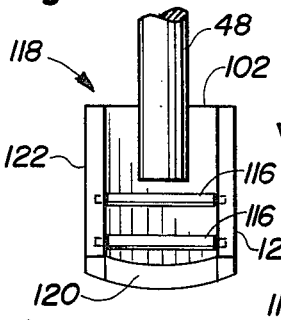
Figure 10B:
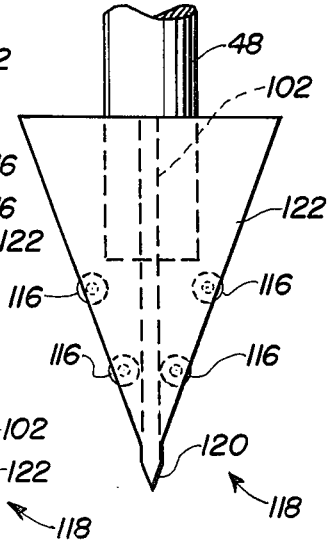
Figure 10C:
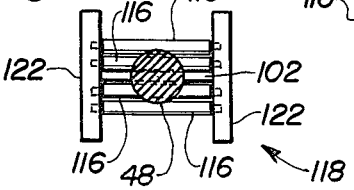
Figure 9A:
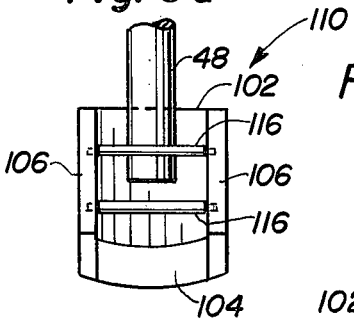
Figure 9B:
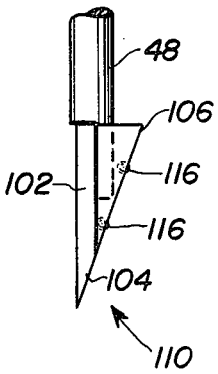
Figure 9C:
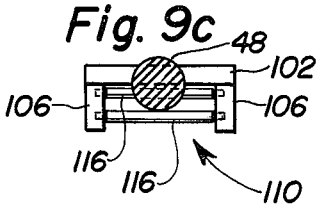

Referring lastly to FIGS. 10*a*, 10*b*, and 10*c* wherein is illustrated respectively front, side, and top views of the full-flanged compound roller wedge blade 118 being the most effective of splitting blade structures for processing the most difficult of splitting condition woods in interchanged use capability either with the slidable hammer version 24 or the manually operable hydraulically powered splitting assembly version 80 of said firewood log splitter 10 in processing firewood log sections which present especially difficult splitting problems beyond those heretofore considered, wherein the blade body 102 thereof is provided with a double tapered cutting chisel 120 which serves as a split starter for engagement thereafter of the blade body bilateral full-flanged wedges 122 each mounting a quad-set of wedge rollers 116 as shown in combination functioning to bring to bear the maximum of a directed splitting force with a minimum of frictional losses in driving the full-flanged compound roller wedge blade 118 through a firewood log section during accomplishment of splitting operations thereon as a result of wedge roller 116 contact only between the splitting blade and firewood log section being split wherein any knurled grain obstructions to such log section splitting are cut through by said double tapered cutting chisel 120.

Although the invention has been herein shown and described in what are conceived to be the most practical and preferred embodiments, it is recognized that departures may be made therefrom within the scope of the invention, which is not to be limited to the precise details disclosed herein but is to be accorded the full scope of the claims so as to embrace any and all equivalent devices and apparatus.

I claim:

1. A manually mobile firewood log splitter adapted to be displaced from one use location to another by means of a caster mounted rigid supporting frame structure comprised of at least two interconnected horizontally and vertically disposed members provided with a rearwardly projecting set of horizontally spaced handles, said manually mobile firewood log splitter comprising in combination:

(a). a slidable hammer splitter assembly having an interchangeable splitting blade connectably assembled at the lower vertical end of a splitting blade support shaft member provided with an integral vertical displacement guide means therefor, said member and said guide means being vertically moveable perpendicularly through a shaped keyway opening within a structural platform member horizontally disposed in transversely connected assembly between two of said interconnected horizontally disposed members of said rigid supporting frame, (b). a slidable hammer impact anvil interchangeably connected to said splitting blade support shaft member by insertable engagement of an upper vertical end of said support shaft within a first axially aligned opening provided in the lower side of said slidable hammer impact anvil and secured therein by insertion of a retaining pin through a communicating set of aligned sidewall openings therefor provided respectively within said slidable hammer impact anvil and said upper vertical end of said splitting blade support shaft member whereby said support shaft communicates vertically downwardly from said anvil through said structural platform member shaped keyway opening to said interchangeable splitting blade, and (c). a slidable impact hammer with an opening therethrough adapted for vertically displaced movement thereof upon a slidable hammer guide shaft connectably assembled at the lower vertical end thereof within a second axially aligned opening provided in the upper side of said slidable hammer impact anvil and upwardly projecting therefrom.

2. The manually mobile firewood log splitter according to claim 1 in which said integral vertical displacement guide means is a guide flange assembled to said splitting blade support shaft member along one side thereof and coincidental with the elongated axis thereof.

3. The manually mobile firewood log splitter according to claim 2 in which said guide flange is provided with a keeper means in the form of a detent extension projecting below the downward disposed end thereof adapted to cooperatively engage a detent extension slot provided in the upward disposed surface of said structural platform member adjacent said keyway opening and arcuately displaced in radii axial alignment therewith.

4. The manually mobile firewood log splitter according to claim 1 in which said slidable hammer impact anvil is provided with a set of opposingly disposed perpendicularly projecting anvil handles.

5. The manually mobile firewood log splitter according to claim 4 in which said slidable impact hammer is provided with a set of opposingly disposed perpendicularly projecting hammer handles.

6. The manually mobile firewood log splitter according to claim 5 in which said slidable hammer impact anvil is provided with a cushion gasket affixed to the lower side surface thereof.

7. The manually mobile firewood log splitter according to claim 6 in which said slidable impact hammer is provided with a slidable impact hammer gasket detachably assembled to the lower end thereof.

8. The manually mobile firewood log splitter according to claim 7 in which said slidable hammer guide shaft is provided with a slidable impact hammer elevation stop assembled to the upward terminal end thereof.

9. The manually mobile firewood log splitter according to claim 8 in which the same is provided with an elevating step pivotally assembled between two of the interconnected vertically disposed members of said rigid supporting frame said step maintained by a connecting tension spring means in a normally spring biased pivotally upward disposition position but adapted to deflect pivotally downward.

10. A manually mobile firewood log splitter adapted to be displaced from one use location to another by means of a caster mounted rigid supporting frame structure comprised of at least two interconnected horizontally and vertically disposed members provided with a rearwardly projecting set of horizontally spaced handles, said manually mobile firewood log splitter comprising in combination:

(a). a vertically disposed manually operable hydraulically powered splitting assembly upwardly supported in affixment to a splitting assembly platform member extension in turn supported upon a structural platform member horizontally disposed in transversely connected assembly between two of said interconnected horizontally disposed members of said rigid supporting frame structure said manually operable hydraulically powered splitting assembly having uppermost thereof a hydraulic cylinder provided with a piston extendible vertically downward in connected communication with a piston extension having an aligned vertically spaced plurality of openings provided therein and adapted to be insertably received within a splitting blade support shaft tubular section provided with a corresponding aligned vertically spaced plurality of openings therein adapted to receive an interchangeable splitting blade connectably assembled at the lower vertical end thereof, (b). an internal vertical displacement guide means for said tubular section of said splitting blade support shaft said guide means and said tubular section being vertically moveable perpendicularly through a shaped keyway opening within a structural platform member horizontally disposed in transversely connected assembly between two of said interconnected horizontally disposed members of said rigid supporting frame, and (c). an elevating step pivotally assembled between two of the interconnected vertically disposed members of said rigid supporting frame said step maintained by a connecting tension spring means in a normally spring biased pivotally upward disposition.

* * * * *